US010031460B2

(12) United States Patent
Hano

(10) Patent No.: US 10,031,460 B2
(45) Date of Patent: Jul. 24, 2018

(54) IMAGE FORMING APPARATUS AND METHOD OF CONTROLLING AN IMAGE FORMING APPARATUS

(71) Applicant: CANON KABUSHIKI KAISHA, Tokyo (JP)

(72) Inventor: Masami Hano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/421,681

(22) Filed: Feb. 1, 2017

(65) Prior Publication Data

US 2017/0248887 A1 Aug. 31, 2017

(30) Foreign Application Priority Data

Feb. 29, 2016 (JP) ..... 2016-037641

(51) Int. Cl.
*G03G 15/00* (2006.01)

(52) U.S. Cl.
CPC ..... *G03G 15/5062* (2013.01); *G03G 2215/00067* (2013.01)

(58) Field of Classification Search
CPC ..... G03G 15/5062; G03G 15/55; G03G 2215/00067
USPC ..... 399/15
See application file for complete search history.

(56) References Cited

U.S. PATENT DOCUMENTS 5,583,644 A 12/1996 Sasanuma et al.
2014/0185047 A1* 7/2014 Tajima ..... G03G 15/5062 356/402
2015/0334263 A1* 11/2015 Chubachi ..... H04N 1/02815 358/475

FOREIGN PATENT DOCUMENTS

JP 2013-228640 A 11/2013

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes an image forming unit configured to form an image on a sheet, and a measuring unit configured to measure reflected light from the sheet, a backup roller configured to convey the sheet while pressing the sheet toward the measuring unit, and a generating unit configured to control the backup roller to convey the sheet, control the measuring unit to measure the reflected light from the sheet, and generate profile data corresponding to measurement results of the reflected light from a plurality of positions in a direction in which the sheet is conveyed.

16 Claims, 13 Drawing Sheets

| 301R | R | G | B |
|---|---|---|---|
| 1 | RR1 | RG1 | RB1 |
| 2 | RR2 | RG2 | RB2 |
| 3 | RR3 | RG3 | RB3 |
| 4 | RR4 | RG4 | RB4 |
| 5 | RR5 | RG5 | RB5 |
| 6 | RR6 | RG6 | RB6 |
| 7 | RR7 | RG7 | RB7 |
| 8 | RR8 | RG8 | RB8 |
| 9 | RR9 | RG9 | RB9 |
| 10 | RR10 | RG10 | RB10 |
| 11 | RR11 | RG11 | RB11 |
| 12 | RR12 | RG12 | RB12 |
| 13 | RR13 | RG13 | RB13 |
| 14 | RR14 | RG14 | RB14 |
| 15 | RR15 | RG15 | RB15 |
| 16 | RR16 | RG16 | RB16 |
| 17 | RR17 | RG17 | RB17 |
| 18 | RR18 | RG18 | RB18 |
| 19 | RR19 | RG19 | RB19 |
| 20 | RR20 | RG20 | RB20 |
| 21 | RR21 | RG21 | RB21 |
| 22 | RR22 | RG22 | RB22 |
| 23 | RR23 | RG23 | RB23 |
| 24 | RR24 | RG24 | RB24 |

| 301F | R | G | B |
|---|---|---|---|
| 1 | FR1 | FG1 | FB1 |
| 2 | FR2 | FG2 | FB2 |
| 3 | FR3 | FG3 | FB3 |
| 4 | FR4 | FG4 | FB4 |
| 5 | FR5 | FG5 | FB5 |
| 6 | FR6 | FG6 | FB6 |
| 7 | FR7 | FG7 | FB7 |
| 8 | FR8 | FG8 | FB8 |
| 9 | FR9 | FG9 | FB9 |
| 10 | FR10 | FG10 | FB10 |
| 11 | FR11 | FG11 | FB11 |
| 12 | FR12 | FG12 | FB12 |
| 13 | FR13 | FG13 | FB13 |
| 14 | FR14 | FG14 | FB14 |
| 15 | FR15 | FG15 | FB15 |
| 16 | FR16 | FG16 | FB16 |
| 17 | FR17 | FG17 | FB17 |
| 18 | FR18 | FG18 | FB18 |
| 19 | FR19 | FG19 | FB19 |
| 20 | FR20 | FG20 | FB20 |
| 21 | FR21 | FG21 | FB21 |
| 22 | FR22 | FG22 | FB22 |
| 23 | FR23 | FG23 | FB23 |
| 24 | FR24 | FG24 | FB24 |

FIG. 9

IMAGE FORMING APPARATUS AND METHOD OF CONTROLLING AN IMAGE FORMING APPARATUS

BACKGROUND OF THE INVENTION

Field of the Invention

The present invention relates to an image forming apparatus configured to measure a measurement image formed on a sheet being conveyed.

Description of the Related Art

Among image forming apparatus, there is a high demand of direct image printers which do not require plates that are used in offset printing or the like. Further, the direct image printers are frequently used as the image forming apparatus in order to respond to a reduction in time required for printing, services to individual customers, printing of a larger number of copies, an environmental problem of paper disposal at the time of printing failure, and the like. Among the direct image printers, ink jet printers which have advantages in terms of price and are suitable for photographic printing, and electrophotographic printers which have high productivity and can obtain a finished work close to that of offset printing are adopted particularly frequently. Such image forming apparatus are desired to have stability in image density and gradation along with the increase in full-color printing.

In order to meet such demands, in U.S. Pat. No. 5,583,644 and Japanese Patent Application Laid-open No. 2013-228640, there is proposed a technology of optimally adjusting the image quality. Those related-art image forming apparatus are configured to form an image after determining image forming conditions, for example, γ correction, based on a density of an image formed on a photosensitive drum or a sheet, to thereby adjust and stabilize the quality of the image to be formed. The image forming conditions are determined when the environment of the image forming apparatus varies or after a predetermined number of images are formed.

When an image formed on a sheet is to be measured, the sheet subjected to image formation is conveyed to a measurement position for measuring the image density by measuring means. The measuring means measures the image from the sheet being conveyed. When the image on the sheet is measured under a state in which the sheet is vibrating (state in which sheet fluttering occurs), the measurement result may have a measurement error. In this case, the image forming conditions have an error.

When the sheet fluttering occurs, a distance between the measuring means and the sheet varies. It has been experimentally confirmed that, when the distance between the measuring means and the sheet varies by about 1 mm, the output value of the measuring means changes by about 15%. As described above, the change in distance between the measuring means and the sheet may cause reduction in accuracy of measuring the image by the measuring means. As a result, it may become difficult to accurately adjust the image quality.

SUMMARY OF THE INVENTION

An image forming apparatus according to the present disclosure includes: an image forming unit configured to form an image on a sheet; a measuring unit configured to measure reflected light from the sheet; a backup roller configured to convey the sheet while pressing the sheet toward the measuring unit; and a generating unit configured to control the backup roller to convey the sheet while pressing the sheet toward the measuring unit, control the measuring unit to measure the reflected light from the sheet conveyed by the backup roller, and generate profile data corresponding to measurement results of the reflected light from a plurality of positions in a direction in which the sheet is conveyed.

Further features of the present invention will become apparent from the following description of exemplary embodiments (with reference to the attached drawings).

BRIEF DESCRIPTION OF THE DRAWINGS

FIG. 9 is an exemplary diagram of measurement results acquired by color sensors.

DESCRIPTION OF THE EMBODIMENTS

Now, an embodiment of the present invention is described in detail with reference to the drawings.

Entire Configuration

Figure 1:
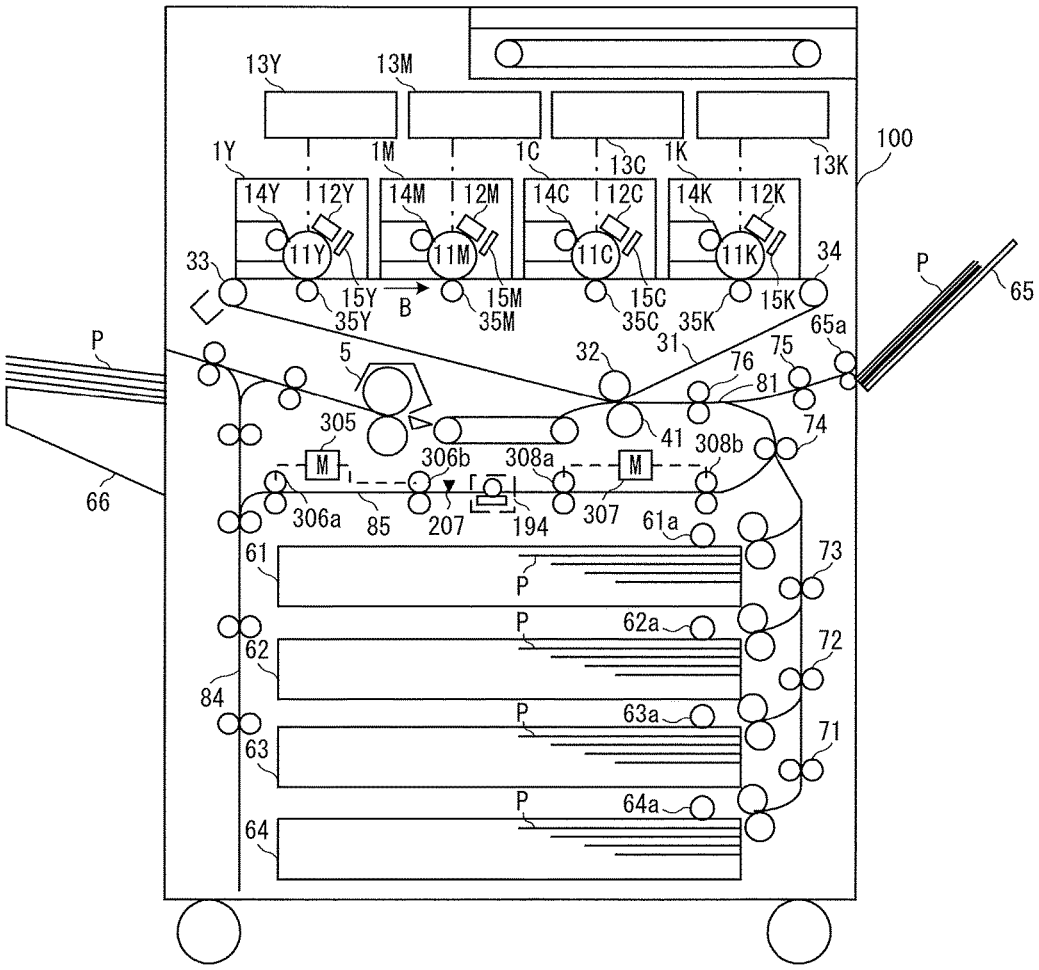
FIG. 1 is a configuration diagram of an image forming apparatus.

FIG. 1 is a configuration diagram of an image forming apparatus according to this embodiment. An image forming apparatus 100 includes an image forming portion 1Y configured to form a yellow image, an image forming portion 1M configured to form a magenta image, an image forming portion 1C configured to forma cyan image, and an image forming portion 1K configured to form a black image. Suffixes Y, M, C, and K given to the reference numerals represent yellow, magenta, cyan, and black, respectively. In the following, unless distinction of color is required, description is made without giving suffices Y, M, C, and K to the reference numerals. The same holds true for other components provided for the respective colors. The image forming apparatus 100 additionally includes exposure devices 13Y, 13M, 13C, and 13K, an intermediate transfer portion, a fixing device 5, and a conveyance mechanism configured to convey a sheet P. The exposure devices 13Y, 13M, 13C, and 13K are provided for the respective colors so as to correspond to the image forming portions 1Y, 1M, 1C, and 1K, respectively.

The image forming portions 1Y, 1M, 1C, and 1K have the same configuration. Description of the image forming portion 1Y is given herein, and description of the image forming portions 1M, 1C, and 1K is omitted. The image forming portion 1Y (1M, 1C, and 1K) includes a photosensitive member 11Y (11M, 11C, and 11K), a charging device 12Y (12M, 12C, and 12K), a developing device 14Y (14M, 14C, and 14K), and a cleaning portion 15Y (15M, 15C, and 15K). The surface of the photosensitive member 11Y is charged by the charging device 12Y, and laser light is radiated by the corresponding exposure device 13Y to form a latent image. The latent image is developed by the developing device 14Y. With this, a toner image is formed on the photosensitive member 11Y.

The photosensitive member 11Y is an image forming member, and is, for example, a rotary-drum electrophotographic photosensitive member having a diameter of 84 mm and an axial length of 370 mm. The photosensitive member 11Y includes a photosensitive layer formed of an organic photoconductor (OPC) having a negative charging characteristic, which is formed on a surface of an aluminum cylinder that is a drum-type conductive base member. The photosensitive layer includes a charge generating layer configured to generate charges through light irradiation and a charge transport layer configured to transport the charges. Under the photosensitive layer, in the order from the cylinder side, there are formed an undercoat layer configured to suppress light interference to be caused by a cylinder defect and configured to prevent interference with the transportation of the charges generated in the upper layer, and an injection blocking layer configured to suppress passage of holes generated in the charge generating layer so that only electrons may pass therethrough. On the photosensitive layer, a surface protective layer is formed to improve the cleaning performance. The photosensitive member 11Y having such a configuration is rotationally driven in a counterclockwise direction of FIG. 1 at a circumferential speed of about 350 mm/sec about the drum axis.

The charging device 12Y is a proximity/contact charging roller configured to charge the photosensitive member 11Y by coming into contact or coming close to the peripheral surface of the photosensitive member 11Y. In the charging device 12Y, both ends of a cored bar (support member) in its longitudinal direction (axial direction) are held in a freely rotatable manner by forming members, respectively. Further, the charging device 12Y is urged toward the photosensitive member 11Y by a pressure spring (not shown). With this, the charging device 12Y is brought into pressure-contact with the surface of the photosensitive member 11Y at a predetermined pressure force. The charging device 12Y is configured to be rotated clockwise in FIG. 1 in accordance with the rotation of the photosensitive member 11Y.

The charging device 12Y is, for example, a roller having an axial length of 330 mm and a diameter of 14 mm. The charging device 12Y has a three-layer configuration in which a lower layer, an intermediate layer, and a surface layer are sequentially laminated on the outer periphery of the cored bar. The cored bar is a stainless-steel round bar having a diameter of 6 mm. The lower layer is an electron conductive layer made of foamed ethylene-propylene-diene rubber (EPDM) in which carbon is dispersed, and has a specific gravity of 0.5 g/cm$^3$, a volume resistivity of from 107 Ω·cm to 109 Ω·cm, and a layer thickness of about 3.5 mm. The intermediate layer is made of nitrile rubber (NBR) in which carbon is dispersed, and has a volume resistivity of from 102 Ω·cm to 105 Ω·cm and a layer thickness of about 500 μm. The surface layer is an ion conductive layer formed by dispersing tin oxide and carbon into an alcohol-soluble nylon resin of a fluorine compound, and has a volume resistivity of from 107 Ω·cm to 1,010 Ω·cm, a surface roughness (10-point average surface roughness Rz defined by JIS) of 1.5 μm, and a layer thickness of about 5 μm.

The charging device 12Y is configured to charge the surface of the photosensitive member 11Y by a charging bias applied from a high-voltage power supply (not shown). The high-voltage power supply includes a DC voltage generating portion and an AC voltage generating portion. The charging bias is an oscillation voltage obtained by superimposing an AC voltage on a DC voltage. In this embodiment, the charging device 12Y is configured to charge the surface of the rotating photosensitive member 11Y to a predetermined negative potential. The charging device 12Y may be a member of a non-contact corona discharge type other than the contact charging roller.

The developing device 14Y is configured to supply developer to the latent image formed on the photosensitive member 11Y by the exposure device 13Y, to thereby form a visible image as the toner image. The developing device 14Y of this embodiment is a reverse developing device of a two-component magnetic brush developing type. The developing device 14Y includes a developing container and a developing sleeve. Two-component developer is stored in the developing container. The two-component developer is a mixture of non-magnetic toner and a magnetic carrier. The weight ratio of toner and a magnetic carrier is about 8:92, and a toner density (TD ratio) is 8%.

The toner is, for example, particles obtained by kneading a resin binder mainly containing polyester with a pigment and then by pulverizing and classifying the kneaded product to have an average particle diameter of about 6 μm. Further, as the magnetic carrier, for example, in a surface oxidization region, unoxidized metals such as iron, nickel, cobalt, manganese, chromium, and rare earth, alloys thereof, or oxide ferrite or the like can be used. A manufacturing method of those magnetic particles is not particularly limited. The magnetic carrier has a volume average particle diameter of from 20 μm to 50 μm, preferably from 30 μm to 40 μm, and a resistivity of 107 Ω·cm more, preferably 108 Ω·cm or more. In this embodiment, the magnetic carrier is formed by coating, with a silicone resin, a core mainly made of ferrite, and has a volume average particle diameter of 35 μm, a resistivity of $5\times10^8$ Ω·cm, and a magnetization of 200 emu/cc.

The developing sleeve is arranged opposed to and close to the photosensitive member 11Y under a state of maintaining a distance of closest approach of 250 μm from the photosensitive member 11Y. A portion at which the photosensitive member 11Y and the developing sleeve are opposed to each other corresponds to a developing portion. The developing sleeve has its surface rotationally driven in a forward direction with respect to a moving direction of the surface of the photosensitive member 11Y at the developing portion. The developing sleeve includes a magnet roller therein. With the magnetic force of the magnet roller, the two-component developer is rotationally conveyed to the developing portion. A magnetic brush layer formed on the surface of the developing sleeve is regulated to a predetermined thin layer by a developer coating blade. The developing sleeve is applied with a predetermined developing bias from a developing bias applying power supply (not shown). The developing bias applied to the developing sleeve is an oscillation voltage obtained by superimposing an AC voltage on a DC voltage. For example, when the charging potential on the photosensitive member 11Y is −800 V, the developing bias has a DC voltage of −620 V, an AC voltage of 1,300 Vpp, and a frequency of 10 kHz. With an electric field generated by the developing bias, toner in the two-component developer is caused to selectively adhere to the latent image on the photosensitive member 11Y. With this, the latent image is developed as the toner image. At this time, the charge amount of the toner image developed on the photosensitive member 11Y is about 40 μC/g. The developer on the developing sleeve that has passed through the developing portion is returned to a developer reservoir portion in the developing container along with the rotation of the developing sleeve.

The cleaning portion 15Y is configured to remove residual toner remaining on the photosensitive member 11Y without being transferred onto an intermediate transfer belt 31 (to be described later) from the photosensitive member 11Y. The cleaning portion 15Y is configured to remove the residual toner with use of a blade or a fur brush.

The exposure device 13Y includes a semiconductor laser serving as a light source, and an optical system including various lenses and a rotary polygon mirror. Laser light emitted from the semiconductor laser of the exposure device 13Y is deflected by the rotary polygon mirror so as to scan the surface of the photosensitive member 11Y. The exposure device 13Y can determine the light amount of the laser light output from the semiconductor laser so as to obtain a predetermined image density. In this embodiment, an image having density and gradation is formed through binary area coverage modulation using pulse width modulation (PWM).

The intermediate transfer portion includes primary transfer portions 35Y, 35M, 35C, and 35K, the intermediate transfer belt 31, and a secondary transfer portion.

The primary transfer portions 35Y, 35M, 35C, and 35K are provided so as to correspond to the image forming portions 1Y, 1M, 1C, and 1K, respectively. The respective primary transfer portions 35Y, 35M, 35C, and 35K have the same configuration. Description of the primary transfer portion 35Y is given herein, and description of the primary transfer portions 35M, 35C, and 35K is omitted. The primary transfer portion 35Y is brought into pressure-contact with the surface of the photosensitive member 11Y across the intermediate transfer belt 31 with a predetermined pressure force. A pressure-contact nip portion formed between the primary transfer portion 35Y and the surface of the photosensitive member 11Y corresponds to a transfer portion. The primary transfer portion 35Y is preferred to be made of a material that has a resistance value of from $1\times10^2$ Ω to $1\times10^8$ Ω when +2 kV is applied thereto under a measurement environment with a temperature of 23° C. and a humidity of 50%. As an example, the primary transfer portion 35Y of this embodiment is an ion conductive sponge roller which is formed of a mixture of nitrile rubber and ethylene-epichlorohydrin copolymer, and has an outer diameter of 16 mm and a cored bar diameter of 8 mm.

The intermediate transfer belt 31 is held between the photosensitive members 11Y, 11M, 11C, and 11K and the primary transfer portions 35Y, 35M, 35C, and 35K, respectively, and conveyed. The intermediate transfer belt 31 is suspended around a drive roller 33, a suspending roller 34, and an inner roller 32 forming the secondary transfer portion, and is rotationally driven by the drive roller 33 in the arrow B direction. The intermediate transfer belt 31 of this embodiment is a belt including an elastic layer having a soft surface in order to handle various sheets P. The intermediate transfer belt 31 prevents defects of transfer onto a sheet P having an uneven surface, and prevents transfer failure called "hollow defects" that are liable to be caused on a coated sheet or an OHP sheet, for example.

The intermediate transfer belt 31 has a three-layer configuration of a base material, the elastic layer, and a coat layer, and has a thickness of about 360 μm. The base material is a conductive polyimide resin material having a thickness of from 80 μm to 90 μm. The elastic layer is formed on the base material by from 200 μm to 300 μm in a laminated manner, and is made of a chloroprene rubber with 60° in JIS-A hardness. The coat layer is configured to secure the release property of the carried toner particles or sheet P, and is an outermost layer having a thickness of from about 5 μm to about 15 μm, which is obtained by dispersing a fluorine resin in a polyurethane resin being a binder. The resistance value of the intermediate transfer belt 31 is adjusted such that the volume resistivity is from $1\times10^9$ Ω·cm to $1\times10^{11}$ Ω·cm, and the surface resistivity is from $1\times10^{11}$ Ω/sq to $1\times10^{13}$ Ω/sq.

Onto the intermediate transfer belt 31, toner images are transferred in a superimposed manner from the photosensitive members 11Y, 11M, 11C, and 11K by the primary transfer portions 35Y, 35M, 35C, and 35K, respectively. At this time, the primary transfer portions 35Y, 35M, 35C, and 35K are applied with a transfer bias voltage (for example, +1,500 V) which has a positive polarity that is opposite to a negative polarity corresponding to the regular charging polarity of toner. With this, the toner images on the photosensitive members 11Y, 11M, 11C, and 11K are sequentially and electrostatically transferred onto the surface of the intermediate transfer belt 31. The toner images transferred onto the intermediate transfer belt 31 are conveyed to the secondary transfer portion by the rotation of the intermediate transfer belt 31.

The secondary transfer portion is a toner image transfer nip portion including the inner roller 32 and an outer roller 41. The secondary transfer portion is configured to hold, between the inner roller 32 and the outer roller 41, the intermediate transfer belt 31 and the sheet P conveyed by the conveyance mechanism, and to apply a predetermined pressure and bias voltage between the inner roller 32 and the outer roller 41, to thereby transfer the toner images from the intermediate transfer belt 31 onto the sheet P. The secondary transfer portion is configured to convey the sheet P having the toner images transferred thereon to the fixing device 5 by the rotation of the inner roller 32 and the outer roller 41.

The fixing device 5 is configured to heat and pressurize the sheet P having the toner images transferred thereon to melt and fix the toner images onto the sheet P. With this, the image formation onto the sheet P is ended. The sheet P subjected to the image formation is delivered to a sheet delivery tray 66 by the conveyance mechanism.

The conveyance mechanism includes sheet feeding cassettes 61 to 64, a manual feed tray 65, pick-up rollers 61*a* to 65*a*, conveyance rollers 71 to 75, a registration roller pair 76, a conveyance path 81, a switch-back conveyance path 84, and a duplex-printing conveyance path 85.

The sheet feeding cassettes 61 to 64 and the manual feed tray 65 can receive the sheets P. The sheets P received in the sheet feeding cassettes 61 to 64 are fed one by one by the pick-up rollers 61*a* to 64*a* in accordance with the timing of image formation by the image forming portions 1Y, 1M, 1C, and 1K. The sheets P fed from the sheet feeding cassettes 61 to 64 are conveyed through the conveyance path 81 by the conveyance rollers 71 to 74 to the registration roller pair 76. The sheets P placed on the manual feed tray 65 are fed one by one by the pick-up roller 65*a* in accordance with the timing of image formation by the image forming portions 1Y, 1M, 1C, and 1K. The sheets P fed from the manual feed tray 65 are conveyed through the conveyance path 81 by the conveyance roller 75 to the registration roller pair 76.

A head part of the sheet P being conveyed is brought into abutment against the registration roller pair 76. With this, the sheet P forms a loop to correct skew feeding. The registration roller pair 76 is configured to convey the sheet P to the secondary transfer portion in accordance with the timing at which the toner images formed on the intermediate transfer belt 31 are conveyed to the secondary transfer portion.

The sheet P having an image formed thereon by the secondary transfer portion and the fixing device 5 is conveyed to the switch-back conveyance path 84 without being delivered to the sheet delivery tray 66 when duplex printing is performed or when image density measurement of this embodiment is performed. The sheet P is conveyed to the switch-back conveyance path 84, and then is fed backward to be conveyed to the duplex-printing conveyance path 85. The duplex-printing conveyance path 85 includes rollers 306*a* and 306*b*, a sheet detecting sensor 207, a color sensor unit 194, and rollers 308*a* and 308*b*.

The rollers 306*a* and 306*b* are configured to convey the sheet P conveyed from the switch-back conveyance path 84 to the color sensor unit 194. The sheet detecting sensor 207 is configured to detect the sheet P conveyed through the duplex-printing conveyance path 85 by the rollers 306*a* and 306*b*. The color sensor unit 194 corresponds to measuring means for measuring the density of the image formed on the sheet P. The rollers 308*a* and 308*b* are configured to convey the sheet P that has passed through the color sensor unit 194 to the registration roller pair 76 through the conveyance path 81. The rollers 306*a* and 306*b* are rotationally driven by a motor 305. The rollers 308*a* and 308*b* are rotationally driven by a motor 307. The rollers 306*a* and 306*b* and the rollers 308*a* and 308*b* are driven by the different motors 305 and 307, and hence the rollers 306*a* and 306*b* and the rollers 308*a* and 308*b* can convey the sheets P at independent timings.

With the above-mentioned configuration, the image forming apparatus 100 can perform image forming processing on a single surface or both surfaces of the sheet P. Further, the image forming apparatus 100 can measure the density of the image formed on the sheet P to correct the image forming conditions based on the measured image density. When the image density is to be measured, the image forming apparatus 100 forms a density patch (measurement image) for image density measurement on the sheet P. The sheet P having the density patch formed thereon is conveyed to the duplex-printing conveyance path 85 such that the image density is measured by the color sensor unit 194.

Color Sensor Unit

Figure 2:
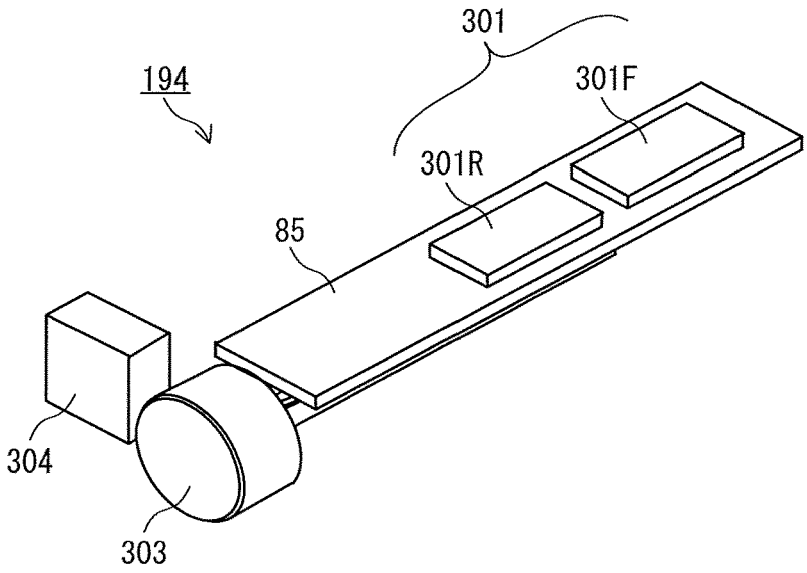
FIG. 2 is a configuration perspective view of a color sensor unit.
Figure 3:
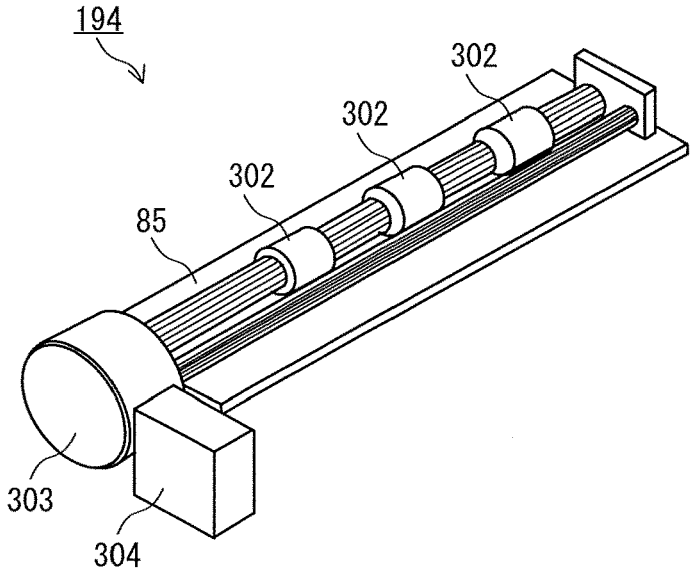
FIG. 3 is a configuration perspective view of the color sensor unit.

FIG. 2 and FIG. 3 are configuration perspective views of the color sensor unit 194. The color sensor unit 194 includes, on an upper side in a vertical direction with respect to the duplex-printing conveyance path 85, a color sensor 301 configured to measure the image density, and, on a lower side in the vertical direction, backup rollers 302 serving as pressing members configured to press the sheet P to the color sensor 301 side. In this embodiment, an example in which two color sensors 301F and 301R are used is described, but the number of the color sensors is not limited thereto.

The backup rollers 302 are rotationally driven by a drive motor 303. Each of the backup rollers 302 of this embodiment is a urethane roller having a diameter of 24 mm , and is an opposing member that is arranged opposed to at least the color sensor 301 on the opposite side of the position at which the color sensor 301 is arranged. The backup rollers 302 are driven by a solenoid 304 to be moved to a pressing or separating position with respect to the duplex-printing conveyance path 85, to thereby press or separate the sheet P to or from the color sensor 301 side. That is, the backup rollers 302 are controlled to have a positional relationship with respect to the color sensor 301 in a first state in which the backup rollers 302 are separated from the color sensor 301 by a predetermined distance or in a second state in which the distance from the backup rollers 302 to the color sensor 301 is smaller than in the case of the first state. The backup rollers 302 are arranged opposed to the color sensor 301, and hence are moved between the pressing position for pressing the sheet P to the color sensor 301 and the separating position for separating the sheet P from the color sensor 301. The backup rollers 302 are set to the separating position during normal image formation, and are set to the pressing position during image density measurement control (to be described later).

Figure 4:
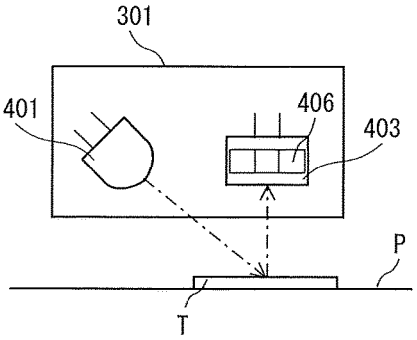
FIG. 4 is a configuration diagram of a color sensor.

FIG. 4 is a configuration diagram of the color sensor 301. The color sensor 301 includes a light emitting element 401 and a light receiving element 403. The light emitting element 401 is, for example, a white light emitting diode (LED). The light receiving element 403 includes, for example, a charge accumulating sensor 406 with an on-chip filter of three colors (for example, RGB) or more.

The light emitting element 401 is configured to radiate light with respect to the sheet P having an image T formed thereon at an incident angle of 45°. The light receiving element 403 is configured to receive light diffusely reflected in the normal direction with respect to the sheet P, to thereby detect the intensity of the light. The light receiving element 403 is configured to output an analog electric signal based on the intensity of the received diffusely reflected light. Light receiving portions of the charge accumulating sensor 406 are arrayed as independent pixels of RGB. The light receiving element 403 may receive the light using a sensor capable of performing multi-color separation, for example, a spectroscopic sensor, other than the charge accumulating sensor 406. The incident angle of the light to the sheet P, the reflected light, and the like are only required to be set so that the image T of the sheet P to be measured can be measured.

Control Device

Figure 5:
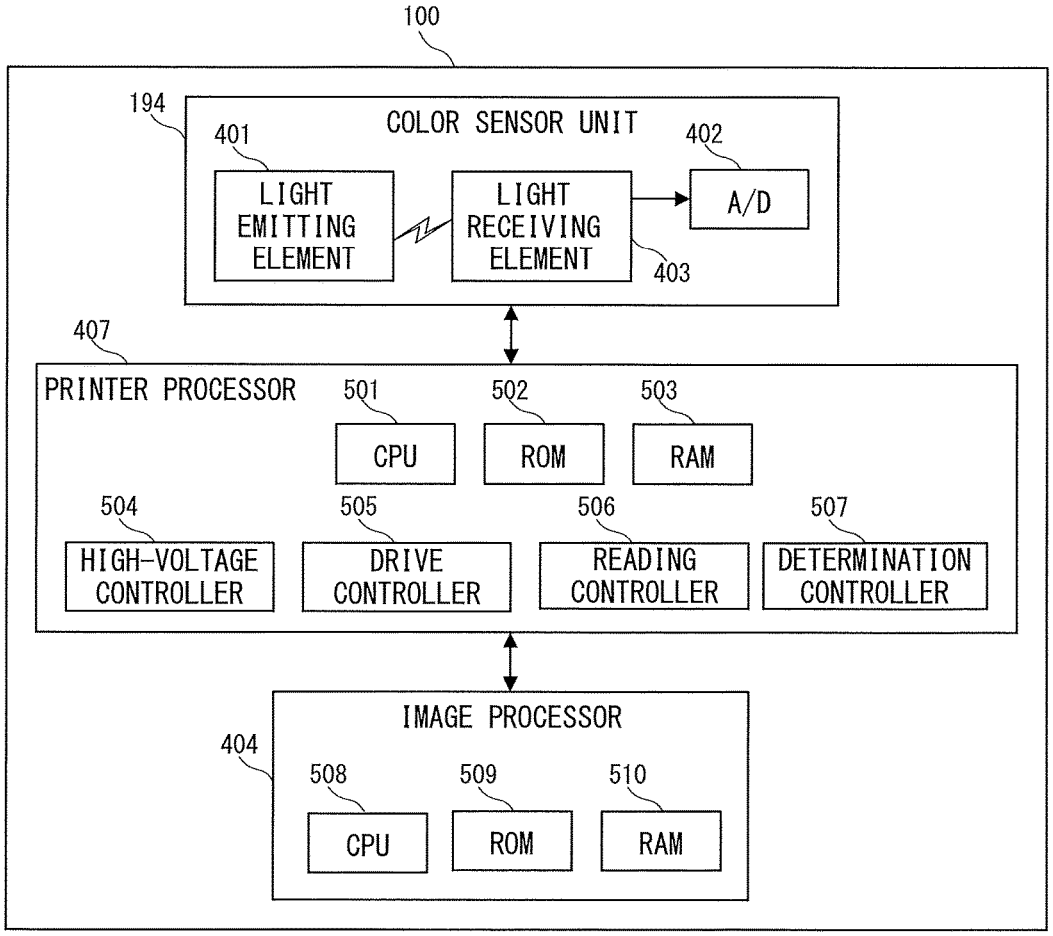
FIG. 5 is a block diagram of a control device.

FIG. 5 is a block diagram of a control device configured to control the operation of the image forming apparatus 100 as described above. The control device is built into the image forming apparatus 100. The control device includes a printer processor 407 and an image processor 404. The printer processor 407 is connected to the color sensor unit 194.

The color sensor unit 194 includes an analog/digital (A/D) converter 402 in addition to the above-mentioned light emitting element 401 and light receiving element 403. The A/D converter 402 is configured to convert an analog electric signal output from the light receiving element 403 into a digital electric signal to transmit the digital electric signal to the printer processor 407.

The printer processor 407 includes a central processing unit (CPU) 501, a read only memory (ROM) 502, and a random access memory (RAM) 503. The CPU 501 is configured to read out a computer program stored in the ROM 502 to execute the computer program with use of the RAM 503 as a work area, to thereby control the operation of the image forming apparatus 100. The printer processor 407 includes a high-voltage controller 504, a drive controller 505, a reading controller 506, and a determination controller 507. The CPU 501 is configured to control the bias voltage of each portion of the image forming apparatus 100 and the operation of the conveyance mechanism by the high-voltage controller 504 and the drive controller 505, to thereby perform the processing of forming an image onto the sheet P.

The CPU 501 is configured to store the digital electric signal acquired from the color sensor unit 194 in the RAM 503, to thereby perform calculation processing for color correction based on various types of information stored in the ROM 502. The printer processor 407 is configured to transmit the calculation result to the image processor 404. The reading controller 506 is configured to control the operation of the color sensor unit 194 through the control of the CPU 501. The determination controller 507 is configured to determine a conveyance behavior state, for example, fluttering of the sheet P, based on the digital electric signal acquired from the color sensor unit 194 through the control of the CPU 501.

The image processor 404 includes a CPU 508, a ROM 509, and a RAM 510. The CPU 508 is configured to read out a computer program stored in the ROM 509 to execute the computer program with use of the RAM 510 as a work area, to thereby control the operation of the image processor 404. The CPU 508 is configured to perform processing necessary for gradation control during image formation, based on the calculation result acquired from the printer processor 407.

In this embodiment, the sheet P is conveyed through the duplex-printing conveyance path 85 under a state in which the density patch for measuring the image density is not formed on the sheet P. The color sensor unit 194 is configured to measure the image density from the sheet P not having the density patch formed thereon. That is, the color sensor unit 194 is configured to measure the image density of a region of the sheet P in which an image is not formed.

Figure 6:
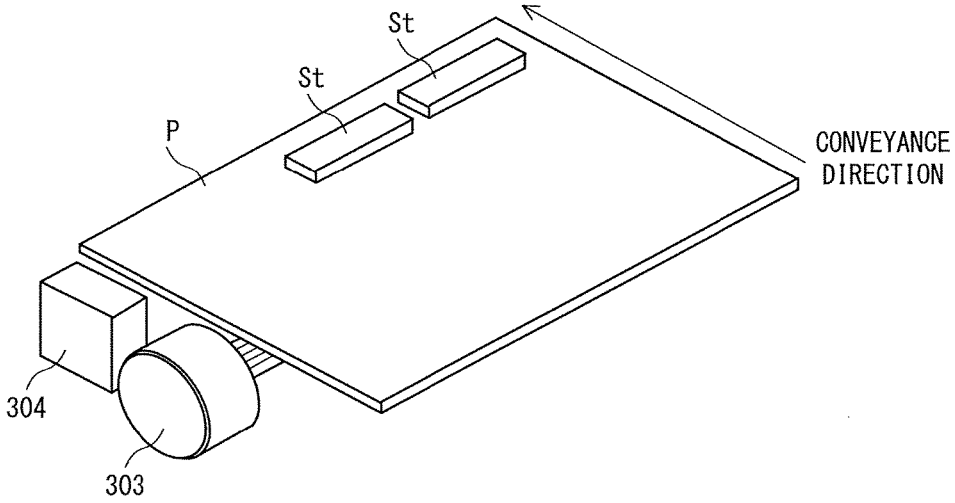
FIG. 6 is a view for illustrating a relationship between the color sensor unit and a sheet.

FIG. 6 is a view for illustrating a relationship between the color sensor unit 194 and the sheet P when the density patch of the sheet P is read. In this view, illustration of the color sensor 301 is omitted in order that the relationship between the color sensor unit 194 and the sheet P may easily be understood.

Trigger patches St are formed on the sheet P. The trigger patches St are formed as many in number as the number of the color sensors 301. When a plurality of color sensors 301 are arranged in a direction orthogonal to the conveyance direction of the sheet P, a plurality of trigger patches St are formed in the direction orthogonal to the conveyance direction. In this embodiment, the trigger patch St is a mixed-color image formed with use of black toner and cyan toner. The image forming apparatus 100 is configured to detect light diffusely reflected from a white part of the sheet P with reference to a timing at which the color sensor 301 detects the trigger patch St. The trigger patch St is used for alignment with a position at which the density patch for image density measurement is formed at the time of gradation correction control (to be described later).

(Conveyance Behavior Determination Processing)

Figure 7:
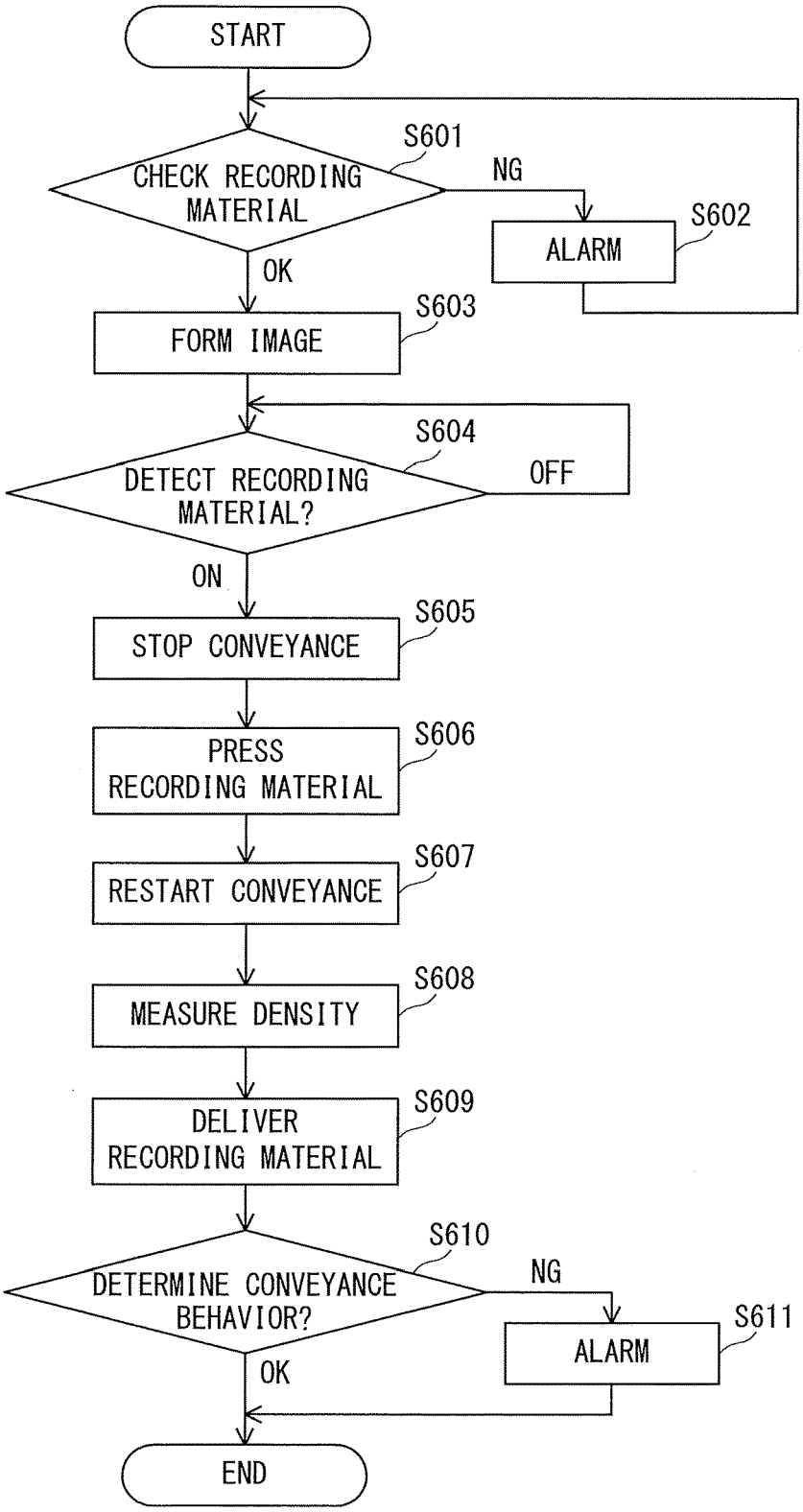
FIG. 7 is a flow chart for illustrating processing of determining a conveyance behavior state.

FIG. 7 is a flow chart for illustrating processing of determining the conveyance behavior state of the sheet P. This processing is executed in response to a conveyance behavior determination instruction from an operation portion (not shown) of the image forming apparatus 100 or an external device connected to the image forming apparatus 100 via a network.

The printer processor 407 first determines whether or not appropriate sheets P are received in the sheet feeding cassettes 61 to 64 or the manual feed tray 65 (Step S601). The sheet P to be used in this embodiment is a plain sheet or a coated sheet having a sheet width of 279.4 mm or more, a conveyance-direction width of 420 mm or more, and a basis weight of from 64 g/m$^2$ to 300 g/m$^2$. The sheet feeding cassettes 61 to 64 and the manual feed tray 65 each include a sensor configured to detect the size of the sheet P. The printer processor 407 determines whether or not the sheet P is appropriate based on the detection result acquired by the sensor and on the user setting. When appropriate sheets P are not received (Step S601: NG), the printer processor 407 causes the operation portion or the external device that has output the conveyance behavior determination instruction to display a warning to put the appropriate sheets P (Step S602).

When appropriate sheets P are received (Step S601: OK), the printer processor 407 performs image forming processing onto the sheet P (Step S603). The printer processor 407 forms the trigger patches St onto the sheet P. The sheet P having the trigger patches St formed thereon passes through the fixing device 5, and is then conveyed through the switch-back conveyance path 84 to the duplex-printing conveyance path 85. The sheet P is conveyed through the duplex-printing conveyance path 85 by the rollers 306*a* and 306*b* to the position of detection by the sheet detecting sensor 207.

When the sheet detecting sensor 207 detects the sheet P (Step S604: ON), the printer processor 407 conveys the sheet P by a predetermined amount, and then stops the conveyance (Step S605). The printer processor 407 stops the rotation of the rollers 306*a* and 306*b* when the leading edge of the sheet P in the conveyance direction reaches a position ahead of the measurement position measured by the color sensor 301 by a predetermined amount (for example, a position ahead of the measurement position by 10 mm) in the conveyance direction.

The printer processor 407 that has stopped the conveyance of the sheet P causes the solenoid 304 to urge the backup rollers 302 to the sheet P side. With this, the sheet P is pressed and pushed to the color sensor 301 side (Step S606). After the backup rollers 302 are urged for a predetermined time period (in this case, after 500 milliseconds), the printer processor 407 drives the backup rollers 302 and the rollers 306*a* and 306*b* to restart the conveyance of the sheet P (Step S607). In this embodiment, the conveyance speed of the sheet P is 348 mm /s. This speed is determined based on the size of the density patch formed at the time of gradation correction (to be described later) and on the time necessary for the color sensor 301 to perform one measurement. The conveyance speed of the sheet P may be set slower than that in this case to improve the density correction accuracy when there is no limitation on control time.

After a predetermined time period is elapsed from the drive start of the backup rollers 302, the color sensor 301 starts the density measurement (Step S608). The printer processor 407 controls the color sensor unit 194 by the reading controller 506 to perform density measurement of the sheet P. After the density measurement is ended, the printer processor 407 drives the rollers 308*a* and 308*b* to convey the sheet P to the conveyance path 81. The sheet P conveyed to the conveyance path 81 passes through the registration roller pair 76, the secondary transfer portion, and the fixing device 5 to be delivered to the sheet delivery tray 66 (Step S609).

The printer processor 407 analyzes the measurement result acquired by the color sensor unit 194 by the determination controller 507, to thereby determine the conveyance behavior state of the sheet P (Step S610). The determination controller 507 determines whether or not the conveyance behavior state is a predetermined behavior. When the conveyance behavior state is the predetermined behavior (Step S610: OK), the printer processor 407 ends the processing of determining the conveyance behavior state of the sheet P. When the conveyance behavior state is not the predetermined behavior (Step S610: NG), the printer processor 407 causes the operation portion or the external device that has output the conveyance behavior determination instruction to display a warning of the determination result to output a notification, and ends the processing (Step S611). When the conveyance behavior state of the sheet P is not the predetermined behavior, a service person carries out positional adjustment of the backup rollers 302 and the solenoid 304 to adjust the conveyance behavior state. After the operation ends, the processing of FIG. 7 is performed again to confirm that the conveyance behavior state of the sheet P is the predetermined behavior.

Figure 8:
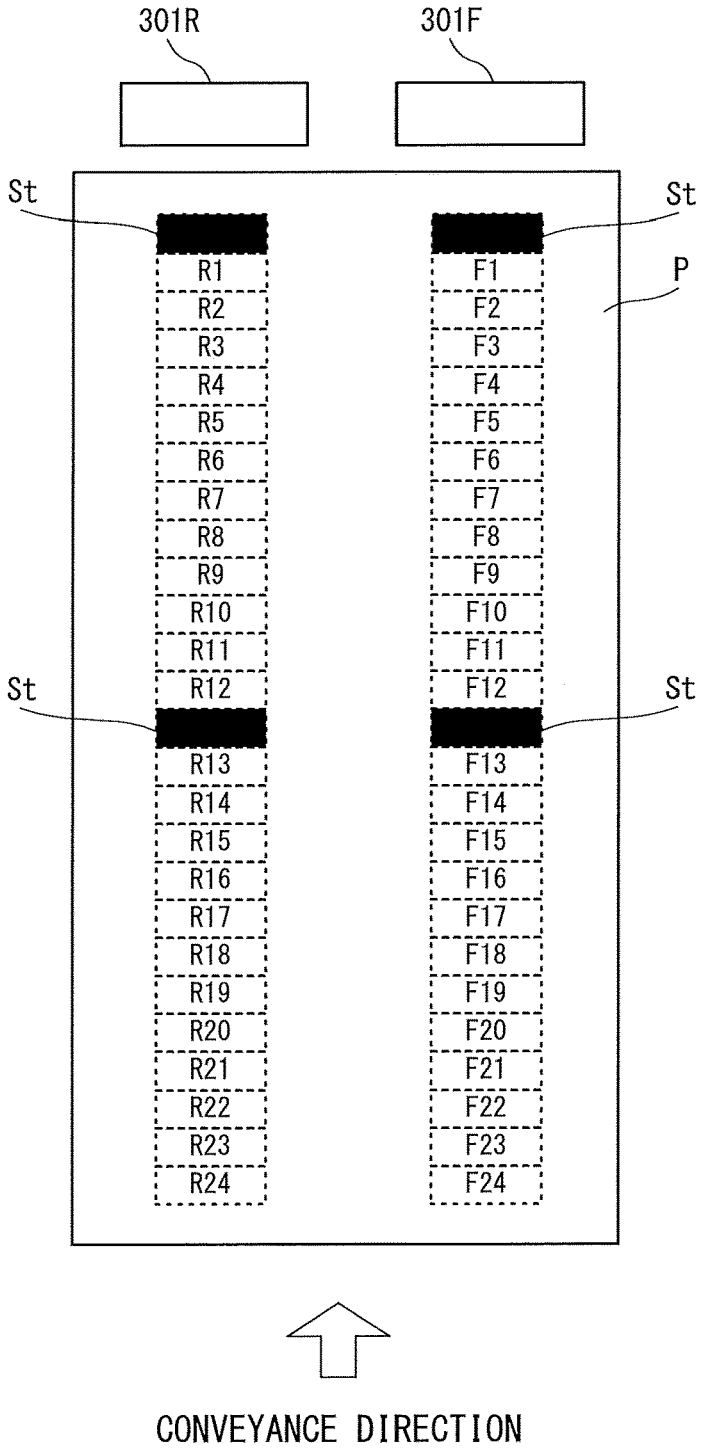
FIG. 8 is an exemplary diagram of a density patch.

The density measurement of the sheet P by the processing of Step S608 is described. FIG. 8 is an exemplary diagram of the density patch (measurement image) on the sheet P. In this embodiment, the color sensor unit 194 includes two color sensors 301R and 301F. The density patch is formed based on positions of measurement by the respective color sensors 301R and 301F.

The sheet P has a plurality of white regions F1 to F24 and R1 to R24 each having the same size as the trigger patch St. The color sensor 301R measures the plurality of white regions R1 to R24 and two trigger patches St. The color sensor 301F measures the plurality of white regions F1 to F24 and two trigger patches St. The plurality of white regions R1 to R24 and F1 to F24 correspond to positions at which the density patches are formed at the time of gradation correction (to be described later). That is, the measurement results of the plurality of white regions R1 to R24 and F1 to F24 correspond to profile data in the conveyance direction of the sheet P. When the conveyance behavior state of the sheet P is the predetermined behavior, the CPU 501 acquires the measurement results of the plurality of white regions R1 to R24 and F1 to F24 as the profile data. When only the determination of the conveyance behavior state of the sheet P is required, the trigger patches St are unnecessary.

FIG. 9 is an exemplary diagram of the measurement results acquired by the color sensors 301R and 301F. The measurement results are stored in the RAM 503 of the printer processor 407. The measurement results are subjected to AD conversion by the A/D converter 402 and are then input to the printer processor 407 as digital electric signals. The digital electric signals are converted into pieces of data of respective colors of red (R), green (G), and blue (B) by the color sensors 301R and 301F. The CPU 501 of the printer processor 407 stores, in the RAM 503, the digital electric signals converted into the pieces of data of respective colors.

Figure 10:
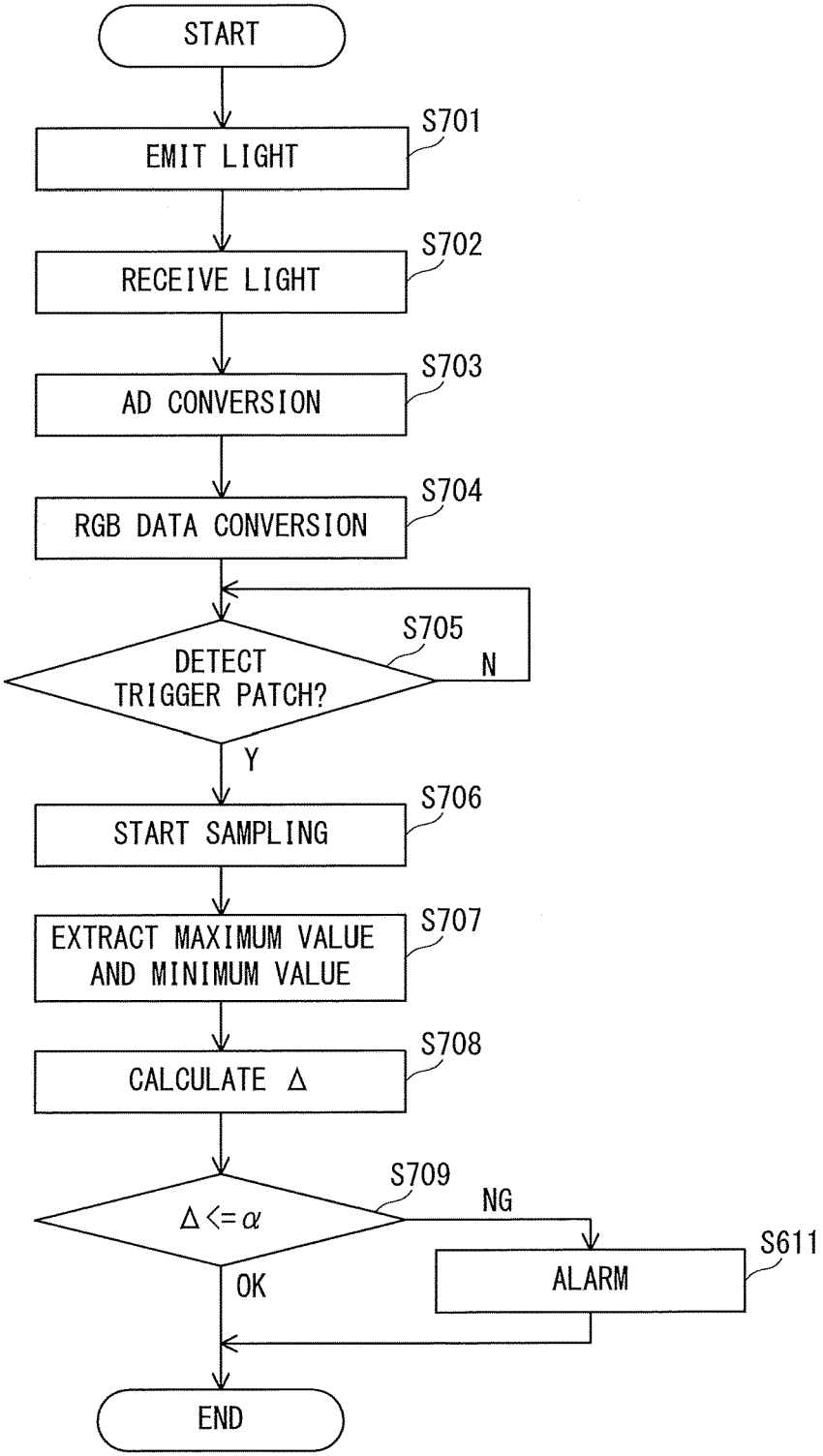
FIG. 10 is a flow chart for illustrating processing of measuring a density and the processing of determining the conveyance behavior state.

FIG. 10 is a flow chart for illustrating the processing of measuring the density of the sheet P and the processing of determining the conveyance behavior state of the sheet P of Step S608 and Step S610 of FIG. 7. The color sensor 301 performs the density measurement under a state in which the sheet P is pressed to the color sensor 301 by the processing of Step S606.

The printer processor 407 controls the operation of the color sensor unit 194 by the reading controller 506. The reading controller 506 causes the light emitting element 401 to emit light at a predetermined light amount. The light emitting element 401 illuminates the sheet P (Step S701). The sheet P reflects the light radiated from the light emitting element 401. The light receiving element 403 receives the light diffusely reflected by the sheet P, and outputs an analog electric signal (Step S702). The A/D converter 402 AD-converts the analog electric signal output from the light receiving element 403 into a digital electric signal (Step S703). The color sensor unit 194 filters the digital electric signal for each of RGB to convert the digital electric signal into data of each color (Step S704). The color sensor unit 194 inputs the data of each color obtained through conversion to the printer processor 407. The CPU 501 of the printer processor 407 stores, in the RAM 503, the data of each color of RGB acquired from the color sensor unit 194.

The CPU 501 determines whether or not the trigger patch St is detected based on the data of each color (Step S705). The color sensor unit 194 measures the density of the sheet P being conveyed, and hence the processing from Step S701 to Step S704 is continuously performed. The CPU 501 determines the detection of the trigger patch St based on the change in measured color from the data continuously acquired from the color sensor unit 194. With the processing of from Step S701 to Step S705, the trigger patch St on the head side of the sheet P in the conveyance direction in FIG. 8 is detected.

When the trigger patch St is detected (Step S705: Y), the CPU 501 of the printer processor 407 starts sampling of the measurement results at certain intervals in the following control (Step S706). In this embodiment, the length in the conveyance direction of each of the white regions F1 to F24 and R1 to R24 is set to 14 mm. The CPU 501 performs sampling a predetermined number of times (in this case, 10 times) for one region, for example. In this embodiment, the CPU 501 calculates the average values of the sampling results based on the following expressions.

The average values of the output values that are measurement results in the respective white regions R1 to R24 acquired by the color sensor 301R:

$$IRRn=(IRR1+IRR2+\ldots+IRR10)/10$$

$$IRGn=(IRG1+IRG2+\ldots+IRR10)/10$$

$$IRBn=(IRB1+IRB2+\ldots+IRR10)/10$$

n: 1 to 24

The average values of the output values that are measurement results in the respective white regions F1 to F24 acquired by the color sensor 301F:

$$IFRn=(IFR1+IFR2+\ldots+IFR10)/10$$

$$IFGn=(IFG1+IFG2+\ldots+IFG10)/10$$

$$IFBn=(IFB1+IFB2+\ldots+IFB10)/10$$

n: 1 to 24

In the processing of Step S608 of FIG. 7, the following processing is performed. The average values of the sampling results are stored in the RAM 503 of the printer processor 407. The CPU 501 of the printer processor 407 extracts the maximum value and the minimum value of the average values of the sampling results of the respective white regions F1 to F24 and R1 to R24 based on the average values of the sampling results (Step S707). In the processing of Step S707, the CPU 501 obtains, from the average values of the measurement results in the respective regions acquired by the color sensor 301R, the maximum value and the minimum value of the R color data, the maximum value and the minimum value of the B color data, and the maximum value and the minimum value of the G color data. Similarly, in the processing of Step S707, the CPU 501 obtains, from the average values of the measurement results in the respective regions acquired by the color sensor 301F, the maximum value and the minimum value of the R color data, the maximum value and the minimum value of the B color data, and the maximum value and the minimum value of the G color data. That is, in the processing of Step S707, the CPU 501 determines the maximum value and the minimum value of the color data in the conveyance direction. The CPU 501 calculates an absolute value Δ of the difference of each color of RGB based on the determined maximum value and minimum value (Step S708). The determination controller 507 of the printer processor 407 determines the conveyance behavior state of the sheet P based on the calculated absolute value Δ (Step S708). This determination is made based on the following expressions, for example.

$$IF\{\Delta IRR,\Delta IFR,\}\geq\alpha \text{ then NG else OK}$$

$$IF\{\Delta IRG,\Delta IFG,\}\geq\alpha \text{ then NG else OK}$$

$$IF\{\Delta IRB,\Delta IFB,\}\geq\alpha \text{ then NG else OK}$$

In this embodiment, α is "45". This numerical value is an upper limit value serving as a threshold value for repeatedly satisfying reproducibility at the time of density correction in the image forming apparatus 100.

The determination controller 507 determines whether the conveyance behavior state is the predetermined behavior based on the above-mentioned expressions or not. That is, the determination controller 507 determines whether the sheet P is vibrating under a state in which the sheet P is conveyed, based on the absolute value Δ of the difference of the color data or not. When the absolute value Δ of the difference of the color data is larger than or equal to a predetermined value, the determination controller 507 determines that the sheet is vibrating under the state in which the sheet P is conveyed. Alternatively, the determination controller 507 determines whether or not the positional adjustment of the backup rollers 302 and the solenoid 304 is necessary based on the absolute value Δ of the difference of the color data. When the absolute value Δ of the difference of the color data is larger than or equal to a predetermined value, the determination controller 507 determines that the positional adjustment of the backup rollers 302 and the solenoid 304 is necessary. When the conveyance behavior state is the predetermined behavior (Step S709: OK), the printer processor 407 ends the processing of determining the conveyance behavior state of the sheet P. When the conveyance behavior state is not the predetermined behavior (Step S709: NG), for example, when the sheet P is fluttering, the printer processor 407 performs processing of Step S611 of FIG. 7. The processing of Step S610 of FIG. 7 corresponds to processing of from Step S707 to Step S709. That is, the determination controller 507 determines that there is no problem in conveyance of the sheet P when the difference value of the measurement results of the respective white regions F1 to F24 and R1 to R24 measured by the color sensors 301F and 301R is a predetermined value or less, and determines that there is a problem in conveyance of the sheet P when the difference value is more than the predetermined value.

Figure 11:
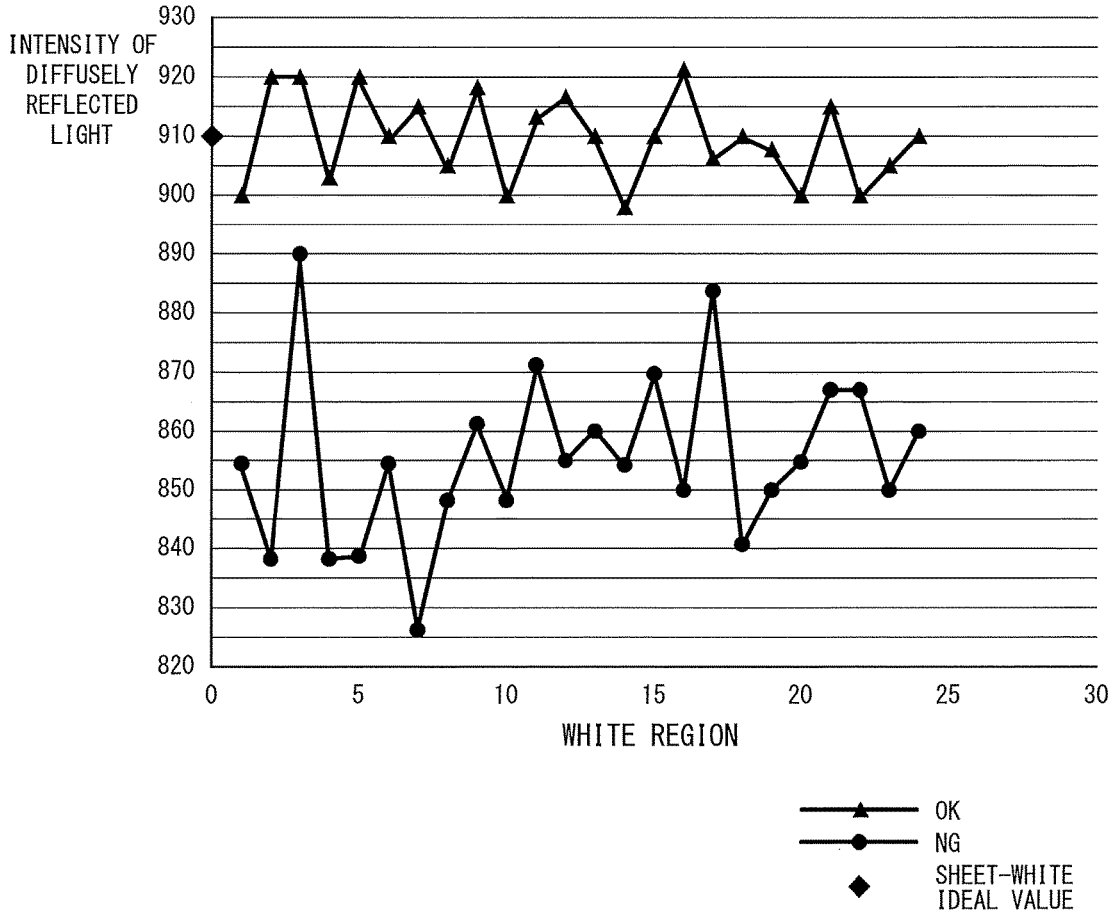
FIG. 11 is an exemplary graph of measurement results acquired by the color sensor unit.

FIG. 11 is an exemplary graph of the measurement results acquired by the color sensor unit 194 when the conveyance behavior state is the predetermined behavior and when the conveyance behavior state is not the predetermined behavior. FIG. 11 represents the intensity of the diffusely reflected light received by the light receiving element 403 for each of the white regions F1 to F24 and R1 to R24. Further, an ideal value obtained when a white sheet P is measured is plotted (diamond shape). The ideal value is "910" in this case. The measurement results when the conveyance behavior state is the predetermined behavior are plotted with triangles. The measurement results when the conveyance behavior state is the predetermined behavior have values ranging from "895 to 925". The measurement results when the conveyance behavior state is not the predetermined behavior are represented by circles. The measurement results when the conveyance behavior state is not the predetermined behavior have values ranging from "825 to 890". The difference between the maximum value and the minimum value of the measurement results corresponds to the absolute value Δ calculated by the processing of Step S708. The measurement results are obtained while conveying a white sheet P having a basis weight of 81.4 g/m$^2$ and a thickness of about 93 μm from the sheet feeding cassette 61 under an environment with a temperature of 23° C. and a humidity of 50%.

As described above, the image forming apparatus 100 of this embodiment can determine whether the conveyance behavior of the sheet P is appropriate or not. When the conveyance behavior is not appropriate, the image forming apparatus 100 urges a user to have the service person perform maintenance to obtain an appropriate conveyance behavior. In this embodiment, the conveyance behavior is determined based on the difference between the maximum value and the minimum value of the sampling results, but otherwise, the conveyance behavior may be determined based on the statistic value (for example, the standard deviation, the dispersion, the kurtosis, or the skewness) of the sampling results.

Density Correction

At the time of control of density correction of an image formed on the sheet P, a sheet-white brightness value is used. The sheet-white brightness value can be determined based on the measurement result acquired by the color sensor unit 194. The image density of each region of the sheet P, which is measured by the color sensor unit 194 at the time of the processing of determining the conveyance behavior, is stored in the RAM 503 as a conveyance behavior profile, and the sheet-white brightness value is determined based on this image density. For example, the maximum value (whitest part) of the measurement results can be set as a sheet-white density to improve the accuracy of the density correction.

Figure 12:
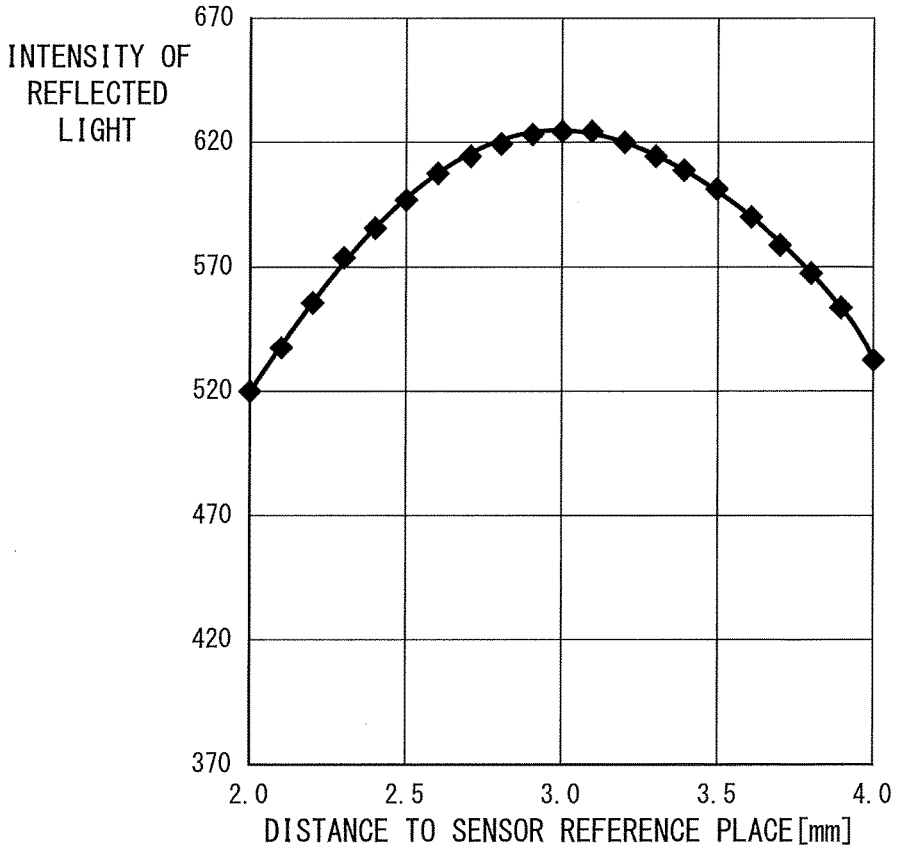
FIG. 12 is a distance characteristic graph of the color sensor.

FIG. 12 is a distance characteristic graph of the color sensor 301. The intensity of the reflected light is proportional to the square of the distance between the reflection object (sheet P) and the color sensor 301. Therefore, there is one local maximum point. Therefore, the highest received light sensitivity is obtained at the inflection point. In the measurement results acquired by the color sensor unit 194 of FIG. 11, values lower than the maximum value represent that the focal distance between the color sensor 301 and the sheet P is not optimum. Therefore, an optimum brightness value as sheet white is desired to be the maximum value of the measurement results. When an AD-converted value of the brightness value of the reflected light measured by the color sensor 301 is calculated by employing a conversion expression that causes a decrease of the sheet-white brightness value, the minimum value of the measurement results is used as a sheet-white density.

Gradation Correction

Figure 13:
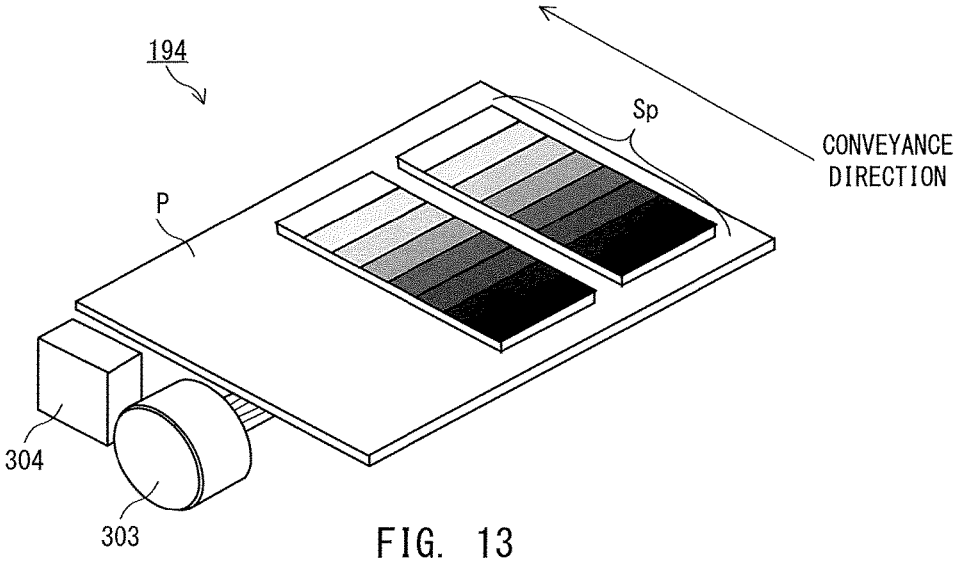
FIG. 13 is a view for illustrating a relationship between the color sensor unit and the sheet.

The image forming apparatus 100 is configured to perform weighting based on the determination result of the conveyance behavior state at the time of gradation correction, to thereby suppress the measurement fluctuation of the image density due to the conveyance behavior of the sheet P and perform gradation correction with high accuracy. FIG. 13 is a view for illustrating a relationship between the color sensor unit 194 and the sheet P when the density patches of the sheet P are read at the time of gradation correction. Density patches Sp that are images for image density measurement are formed on the sheet P. The density patches Sp are arrayed at a certain interval based on the number of the color sensors 301 in the direction orthogonal to the conveyance direction of the sheet P. The density patches Sp are each formed to have different colors including sheet white, densities, and screens.

The color sensor 301 measures the image density based on the diffusely reflected light from the density patch Sp formed on the sheet P. The CPU 501 of the printer processor 407 performs color separation of the data, which has been subjected to filtering for each color of RGB by the color sensor 301, into CMYK, to thereby perform gradation correction in cooperation with the image processor 404.

Figure 14:
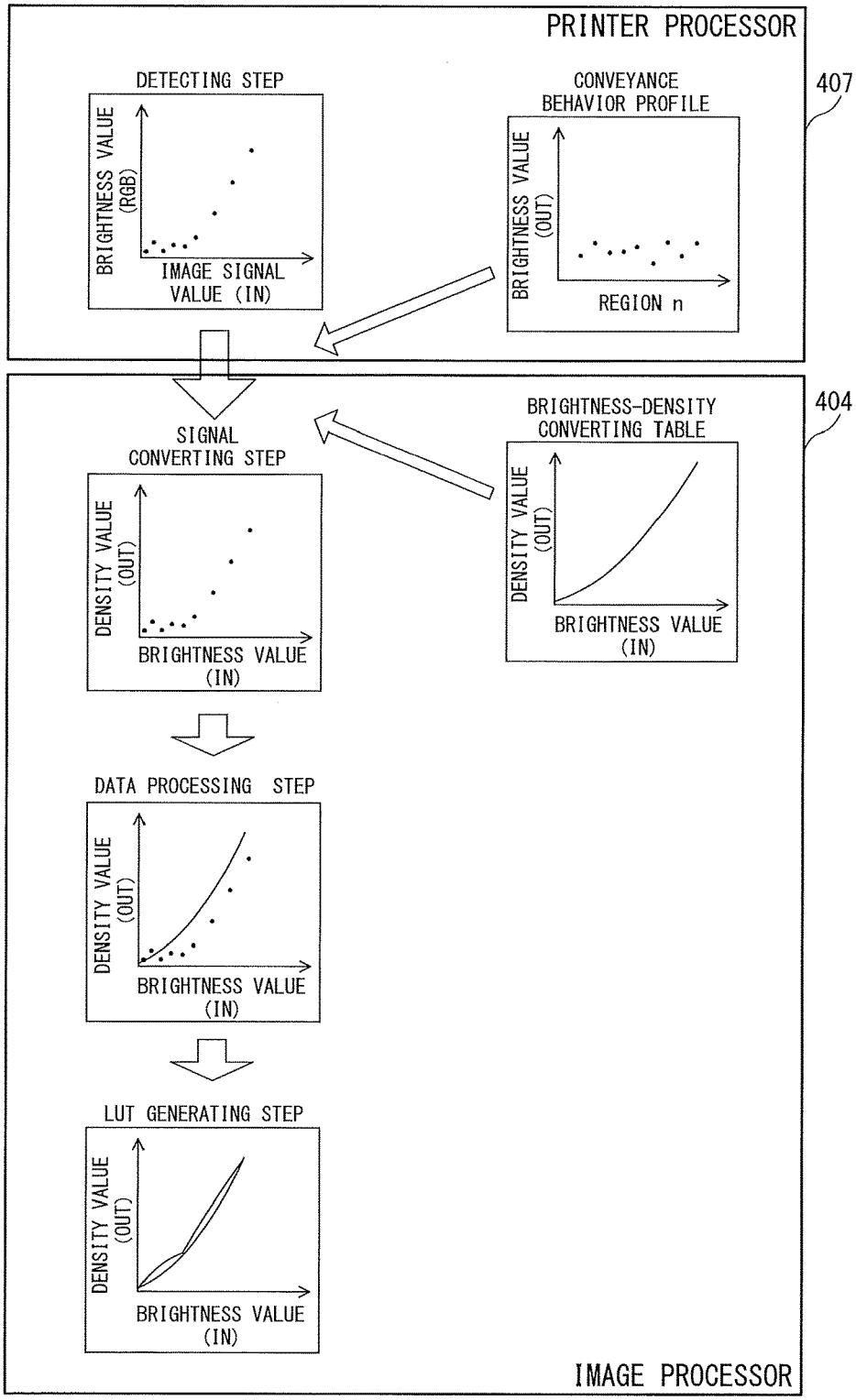
FIG. 14 is an explanatory diagram of processing at the time of gradation correction.

FIG. 14 is an explanatory diagram of processing at the time of gradation correction.

The data of respective colors of RGB generated by the color sensor unit 194 is converted by a color matching table stored in the ROM 502 of the printer processor 407, and is further converted by the color separation table into CMYK signals. In this embodiment, the relationship of additive color mixing is used to separate the respective pieces of data (brightness values) of RGB into the CMYK signals (image signal values). The CPU 501 of the printer processor 407 generates the Y signal, the M signal, the C signal, and the K signal based on the B signal, the G signal, the R signal, and the G signal, respectively, in accordance with the type of the density patch Sp.

The CMYK signals are transmitted to the image processor 404. The CPU 508 of the image processor 404 converts the CMYK signals representing the brightness into density signal values based on a brightness-density conversion table stored in the ROM 509 to generate a gradation table, and stores the generated gradation table in the RAM 510. The above-mentioned processing is performed in a detecting step and a signal converting step of FIG. 14.

In this embodiment, before the brightness-density conversion is performed, the determination result of the conveyance behavior state of the sheet P is reflected based on the conveyance behavior profile. With this, weighting of the fluttering of the sheet P at the same position of the sheet P is performed, and thus the accuracy of the gradation correction can be improved. Before the sheet P is conveyed to the position of measurement by the color sensor unit 194, the sheet P is temporarily stopped and is then conveyed. Therefore, the sheet P is always conveyed to the position of measurement by the color sensor unit 194 with the same behavior. With this, correlation can be obtained with the sheet-white brightness value measured at a highlight portion, which is particularly susceptible to the fluttering of the sheet P. A value close to the brightness value that is to be actually measured by the color sensor unit 194 is measured, and hence the accuracy of the gradation correction is improved.

In order to match the generated gradation table with a reference gradation target table stored in the ROM 509, the CPU 508 of the image processor 404 performs data processing, for example, inverse transform. In order to correct the gradation characteristic of the image to be formed by the image forming apparatus to an ideal gradation characteristic, the CPU 508 generates a gradation correction table and stores the table in the RAM 510. In the following, the gradation correction table is referred to as a look up table (LUT). The above-mentioned processing is performed in a data processing step and an LUT generating step of FIG. 14.

Figure 15:
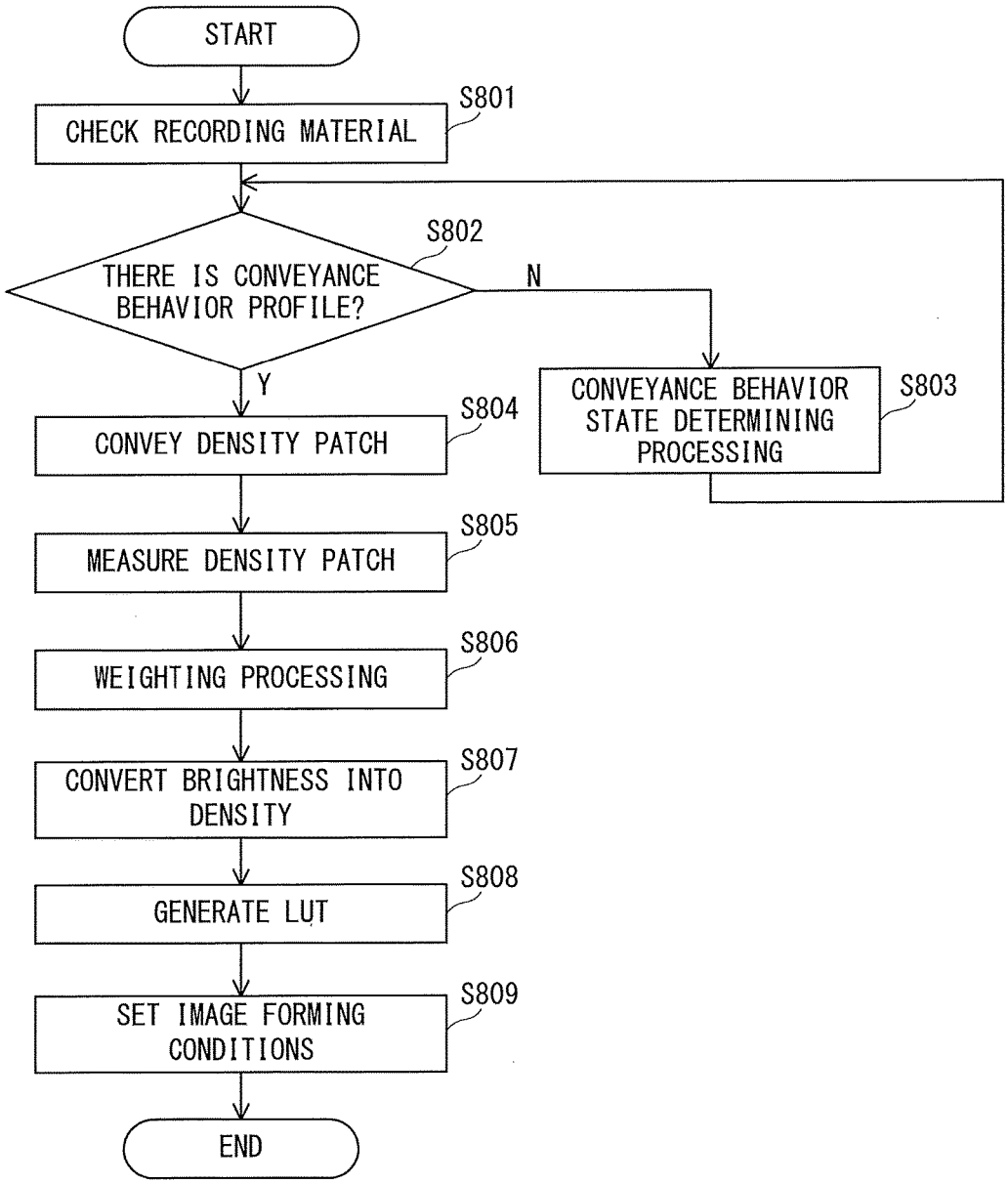
FIG. 15 is a flow chart for illustrating processing of setting image forming conditions including gradation correction.

The printer processor 407 sets the image forming conditions such as various bias voltages and drive conditions during image formation based on the LUT generated in the LUT generating step, and performs image formation by the CPU 501, the high-voltage controller 504, and the drive controller 505. FIG. 15 is a flow chart for illustrating processing of setting the image forming conditions including the gradation correction. The image forming apparatus 100 executes this processing after acquiring an instruction for the processing of setting the image forming conditions from the operation portion or the external device.

The CPU 501 of the printer processor 407 acquires the instruction for the processing of setting the image forming conditions to check whether or not the sheet P to be used for gradation correction is placed on the sheet feeding cassettes 61 to 64 or the manual feed tray 65 (Step S801). The CPU 501 checks whether or not the conveyance behavior profile is stored in the RAM 503 (Step S802). When the conveyance behavior profile is not stored (Step S802: N), the CPU 501 of the printer processor 407 executes the processing of determining the conveyance behavior state of FIG. 7 to store the conveyance behavior profile to the RAM 503 (Step S803).

When the conveyance behavior profile is stored (Step S802: Y), the CPU 501 of the printer processor 407 forms the density patches of FIG. 13 on the sheet P and conveys the sheet P to the duplex-printing conveyance path 85 (Step S804). The CPU 501 sequentially acquires the measurement results of the density patches from the color sensor 301 to store the measurement results in the RAM 503 (Step S805). The CPU 501 performs weighting processing based on the conveyance behavior profile with respect to the acquired measurement results (Step S806). This processing is described in detail later.

The CPU 508 of the image processor 404 converts the brightness value that is the measurement result acquired by the color sensor 301 subjected to weighting into a density value (Step S807). With this, the gradation table is generated. The CPU 508 performs calculation processing so as to match the gradation table with the gradation target table, to thereby generate the final LUT to be used during image formation (Step S808).

The CPU 501 of the printer processor 407 sets the image forming conditions to be used during the image formation based on the LUT generated by the image processor 404 (Step S809). The CPU 501 of the printer processor 407 stores the generated image forming conditions to the RAM 503, and causes the operation portion or the external device to notify the user that the processing of setting the image forming conditions is ended. The image forming conditions are not limited to the gradation correction table. The image forming conditions include, for example, a charging bias to be applied to the charging devices 12Y, 12M, 12C, and 12K from the high-voltage power supply. Further, the image forming conditions include, for example, intensity of laser light of the exposure devices 13Y, 13M, 13C, and 13K. Further, the image forming conditions include, for example, a developing bias to be applied to the developing sleeves of the developing devices 14Y, 14M, 14C, and 14K.

Figure 16:
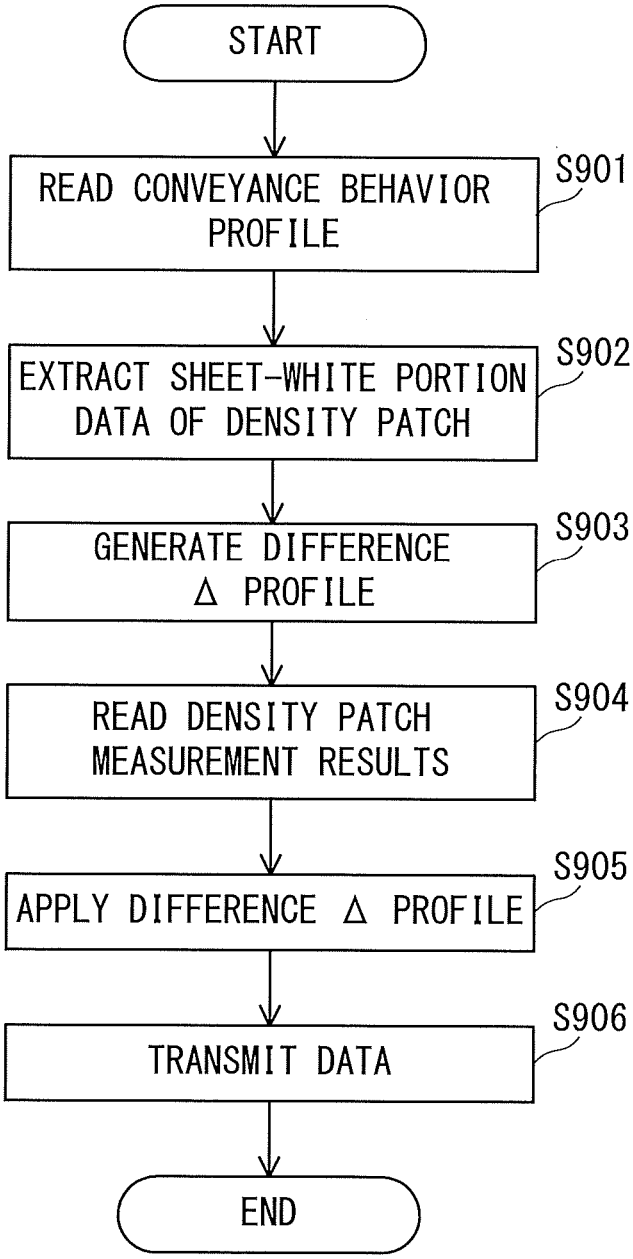
FIG. 16 is a flow chart for illustrating weighting processing.

FIG. 16 is a flow chart for illustrating the weighting processing of Step S806.

The CPU 501 of the printer processor 407 reads the conveyance behavior profile from the RAM 503 (Step S901). The CPU 501 extracts the data of the same position as the sheet-white portion of the density patch from the conveyance behavior profile (Step S902). The CPU 501 generates a difference profile of the respective regions including sheet white with the extracted data being set as a center value (Step S903). In this embodiment, the CPU 501 generates the difference Δ profile by multiplying the difference between the brightness at the density patch and the brightness at the sheet-white portion by "−1".

The CPU 501 of the printer processor 407 reads the measurement results of the density patches stored in the RAM 503 in the processing of Step S805 (Step S904). The CPU 501 adds the read measurement results to the difference Δ profile, to thereby apply the difference Δ profile to the measurement results (Step S905). The CPU 501 transmits, to the image processor 404, the results of correction including addition as measurement results subjected to weighting (Step S906). In this manner, the weighting processing is ended.

The image forming apparatus 100 of this embodiment as described above can suppress loss of gradation due to the calculation processing having a measurement error caused by the fluttering of the sheet P particularly in the highlight portion, and thus the image forming apparatus 100 can correct the density with high accuracy. Further, the image forming apparatus 100 can provide data maintaining the gradation performance instead of an LUT having a large inflection point. In this embodiment, data obtained through simple addition to the density measurement results is used, but the present invention is not limited thereto. For example, a weighting coefficient can be further multiplied for each gradation because the influence due to fluctuation in sheet white increases from the highlight portion to the dark portion.

The image forming apparatus 100 measures the density under a state in which the sheet P is pressed to the color sensor 301, and hence can accurately make conveyance behavior abnormality determination. Further, with use of the profile of the measurement results (conveyance behavior profile), the fluttering amount of the sheet P can be fed back to improve the accuracy of the gradation correction. As described above, the image forming apparatus 100 can determine the image forming conditions with high accuracy based on the measurement results of the measurement image formed on the conveyed sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-037641, filed Feb. 29, 2016 which is hereby incorporated by reference herein in its entirety.

What is claimed is:

1. An image forming apparatus, comprising:

an image forming unit configured to form an image on a sheet;

a measuring unit configured to measure reflected light from the sheet;

a backup roller configured to convey the sheet while pressing the sheet toward the measuring unit;

a generating unit configured to control the backup roller to convey the sheet while pressing the sheet toward the measuring unit, control the measuring unit to measure the reflected light from the sheet conveyed by the backup roller, and generate profile data corresponding to measurement results of the reflected light from a plurality of positions in a direction in which the sheet is conveyed; and a controller configured to control a positional relationship between the measuring unit and the backup roller to be one of a first state and a second state in which a distance between the measuring unit and the backup roller is shorter than in a case of the first state, wherein the controller comprises a determining unit configured to determine whether it is necessary to control the positional relationship from the first state to the second state or not, based on measurement results, acquired by the measuring unit, of a sheet not having an image formed thereon.

2. The image forming apparatus according to claim 1, further comprising a correcting unit configured to correct an image forming condition based on the profile data generated by the generating unit and measurement results of the reflected light from a measurement image by the measuring unit, wherein the image forming unit forms the measurement image on the sheet.

3. The image forming apparatus according to claim 2, wherein the measuring unit measures the reflected light from the sheet not having the measurement image formed thereon, and measures the reflected light from the sheet having the measurement image formed thereon, at a position of the sheet at which the measurement image is to be formed.

4. The image forming apparatus according to claim 1, wherein the controller comprises a drive unit configured to be driven such that the backup roller is moved toward the measuring unit.

5. The image forming apparatus according to claim 1, wherein the determining unit is configured to determine whether it is necessary to control the positional relationship from the first state to the second state or not, based on a difference between a maximum value and a minimum value of output values of the measurement results, acquired by the measuring unit, of the sheet not having the image formed thereon.

6. The image forming apparatus according to claim 1, further comprising a notifying unit configured to give a notification of information relating to a determination result acquired by the determining unit.

7. An image forming apparatus, comprising:

an image forming unit configured to form an image on a sheet;

a conveying unit configured to convey a sheet, on which a measurement image and a trigger image are formed, through a conveyance path;

a measuring unit, provided in the conveyance path, configured to measure reflected light from the measurement image and the trigger image formed on the sheet;

a backup member configured to press, in the conveyance path, the sheet toward the measuring unit; and a controller configured to perform first processing and second processing, wherein the first processing includes:

controlling the image forming unit to form the trigger image and the measurement image on a first sheet;

controlling the conveying unit to convey the first sheet;

controlling the backup member to press the first sheet toward the measuring unit;

controlling the measuring unit to measure, while conveying the first sheet, reflected light from the trigger image formed on the first sheet and the measurement image formed on the first sheet; and controlling an image forming condition of the image forming unit based on a measurement result of the reflected light from the trigger image formed on the first sheet and a measurement result of the reflected light from the measurement image formed on the first sheet, and, wherein the second processing includes:

controlling the image forming unit to form the trigger image on a second sheet, without forming the measurement image;

controlling the conveying unit to convey the second sheet;

controlling the backup member to press the second sheet toward the measuring unit;

controlling the measuring unit to measure, while conveying the second sheet, the reflected light from the trigger image formed on the second sheet and an area of the second sheet on which the trigger image of the second sheet is not formed; and determining an abnormality in conveyance by the conveying unit based on a measurement result of the reflected light from the trigger image formed on the second sheet and a measurement result of the reflected light from the area on which the trigger image of the second sheet is not formed.

8. The image forming apparatus according to claim 7, wherein the second processing further comprises processing to notify a determination result of the second processing.

9. The image forming apparatus according to claim 7, wherein the controller generates correction data based on the measurement result of the reflected light from the area measured in the second processing, and the controller controls, in the first processing, the image forming condition based on the measurement result of the reflected light from the trigger image formed on the first sheet, the correction data, and the measurement result of the reflected light from the measurement image formed on the first sheet.

10. The image forming apparatus according to claim 7, wherein the second sheet has a predetermined size, and the second sheet is of a predetermined type.

11. The image forming apparatus according to claim 7, wherein the image forming condition corresponds to a gradation table for correcting a gradation characteristic of an image to be formed by the image forming unit.

12. The image forming apparatus according to claim 7, wherein the trigger image is used for determining a position on the first sheet on which the measurement image was formed in the first processing.

13. The image forming apparatus according to claim 12, wherein the trigger image is used for determining the area of the second sheet in the second processing.

14. The image forming apparatus according to claim 7, wherein the measuring unit further includes a light emitting portion and a light receiving portion configured to receive the reflected light from the measurement image or the reflected light from the area, the measuring unit outputs an output value based on a receiving result by the light receiving portion, and the controller, in a case where the second processing is performed, determines the abnormality in conveyance by the conveying unit based on a difference between a maximum output value and a minimum output value among output values corresponding to measurement results of reflected light from a plurality of positions in the area.

15. The image forming apparatus according to claim 7, wherein the controller controls a positional relationship between the measuring unit and the backup member to be one of a first state and a second state in which a distance between the measuring unit and the backup member is shorter than in a case of the first state, the controller controls the backup member to be in the second state before measuring, by the measuring unit, the reflected light from the trigger image formed on the first sheet, and the controller controls the backup member to be in the second state before measuring, by the measuring unit, the reflected light from the trigger image formed on the second sheet.

16. A method of controlling an image forming apparatus, the image forming apparatus including an image forming unit configured to form an image on a sheet, a conveying unit configured to convey a sheet, on which a measurement image and a trigger image are formed, through a conveyance path, a measuring unit, provided in the conveyance path, configured to measure reflected light from the measurement image and the trigger image formed on the sheet, and a backup member configured to press, in the conveyance path, the sheet toward the measuring unit, the method comprising:

forming the trigger image and the measurement image on a first sheet;

conveying the first sheet to the measuring unit;

pressing, using the backup member, the first sheet toward the measuring unit;

measuring, while conveying the first sheet, reflected light from the trigger image formed on the first sheet and the measurement image formed on the first sheet;

controlling an image forming condition of the image forming unit based on a measurement result of the reflected light from the trigger image formed on the first sheet and a measurement result of the reflected light from the measurement image formed on the first sheet;

forming the trigger image on a second sheet, without forming the measurement image;

conveying the second sheet to the measuring unit;

pressing, using the backup member, the second sheet toward the measuring unit;

measuring, while conveying the second sheet, the reflected light from the trigger image formed on the second sheet and an area of the second sheet on which the trigger image of the second sheet is not formed; and determining an abnormality in conveyance based on a measurement result of the reflected light from the trigger image formed on the second sheet and a measurement result of the reflected light from the area.

* * * * *